US005587624A

United States Patent [19]

Komaki

[11] Patent Number: 5,587,624

[45] Date of Patent: Dec. 24, 1996

[54] PLASMA DISPLAY PANEL

[75] Inventor: Toshihiro Komaki, Yamanashi-ken, Japan

[73] Assignee: Pioneer Electronic Corporation, Tokyo, Japan

[21] Appl. No.: 388,470

[22] Filed: Feb. 14, 1995

[30] Foreign Application Priority Data

Feb. 23, 1994 [JP] Japan ..... 6-025076
Jun. 23, 1994 [JP] Japan ..... 6-141775

[51] Int. Cl.[6] ..... H01J 17/49

[52] U.S. Cl. ..... 313/584; 313/491

[58] Field of Search ..... 313/584, 585, 313/491, 586, 587, 582; 315/169.4

[56] References Cited

U.S. PATENT DOCUMENTS 3,646,384 2/1972 Lay ..... 313/584
4,423,356 12/1983 Sato et al. ..... 313/582
4,737,687 4/1988 Shinoda et al. ..... 315/169.4
5,075,597 12/1991 Salavin et al. ..... 315/169.4
5,086,257 2/1992 Gay et al. ..... 315/169.4

FOREIGN PATENT DOCUMENTS 0135382 8/1984 European Pat. Off. ..... H01J 17/49

*Primary Examiner*—Michael Horabik
*Assistant Examiner*—Michael Day
*Attorney, Agent, or Firm*—Sughrue, Mion, Zinn, Macpeak & Seas

[57] ABSTRACT

A plasma display panel includes a plurality of sustaining electrodes provided between substrates and arranged in pairs, a plurality of address electrodes disposed perpendicular to the sustaining electrodes thereby forming a matrix and defining a plurality of pixels, each pixel being defined by a pair of sustaining electrodes and a pair of address electrodes; wherein the sustaining electrodes have a projection at each pixel; and the area of the projection varies from the central portion of the panel to the peripheral portion of the panel.

4 Claims, 5 Drawing Sheets

PLASMA DISPLAY PANEL

BACKGROUND OF THE INVENTION

The present invention relates to a plasma display panel used in a television set.

As a conventional plasma display panel (PDP) having a matrix display, a face-discharge type PDP is known. A face-discharge type PDP having a three-electrode matrix display comprises a front substrate as a display side, and a rear substrate provided corresponding to the front substrate at a distance, thereby forming a discharge space there-between. The front substrate has a plurality of pairs of sustaining electrodes disposed thereon parallel with each other in the lateral direction, and a dielectric layer provided for covering the sustaining electrodes. The rear substrate has a plurality of ribs parallelly disposed in the vertical direction perpendicular to the sustaining electrodes of the front substrate for dividing the discharge space, a plurality of address electrodes provided in spaces between the ribs, and fluorescent film provided for covering the address electrodes.

In such a PDP, the dielectric layer and the ribs are formed by printing and baking glass paste. During baking of the glass paste, the baking temperature exceeds the distortion temperature of the glass. Thus, the dimension of the glass varies in accordance with thermal expansion and contraction. Therefore, when the substrates are secured to each other, it is difficult to accurately position the substrates. In particular, the deflection of both substrates is large in a peripheral region of the PDP.

FIG. 8 shows a matrix display of a conventional PDP. A pair of sustaining electrodes 1 and 2 are disposed in parallel with each other in a unit luminous region 3 of a discharge space defined by ribs 4. In such an arrangement, if the electrodes 1 and 2 deflect as shown by the dot-dash lines, the effective area of the luminous region does not change. Thus, the positioning of front and rear substrates can be easily and accurately performed. However, there are disadvantages in that luminous efficacy is reduced.

In order to increase the luminous efficacy, it is possible to form a projection on a side of the electrode. However, the projection gives rise to another problem.

FIG. 9 shows an example of projections 5 formed on a side of each electrode so as to oppose each other. By providing the projections, luminous efficacy and luminance are increased. However, if the electrodes 1 and 2 deflect as shown in the figure, a part of the projection 5 may be hidden by the rib 4. As a result, the area of the luminous region is reduced, so that discharge does not occur at the region or error discharge may occur.

SUMMARY OF THE INVENTION

An object of the present invention is to provide a plasma display panel in which the positioning of the panel is easily determined and with high luminous efficacy and luminance.

According to the present invention, there is provided a plasma display panel having a pair of substrates, a plurality of sustaining electrodes provided between the substrates and arranged in pairs, a plurality of address electrodes disposed in a perpendicular direction to the sustaining electrodes, thereby forming a matrix defining pixels between the pair of sustaining electrodes and each of the address electrodes.

Each of the sustaining electrode has a central portion for providing a large luminous efficacy in a central portion of the panel, and each pair of the sustaining electrodes has parallel electrode portions formed at opposite peripheral portions of the panel.

The central portion of each of the sustaining electrodes has a wide width.

According to one aspect of the invention, the central portions of each pair of the sustaining electrodes have projections opposite to each other at each of the pixels.

Other objects and features of this invention will become understood from the following description with reference to the accompanying drawings.

DETAILED DESCRIPTION OF THE PREFERRED EMBODIMENTS

Figure 1:
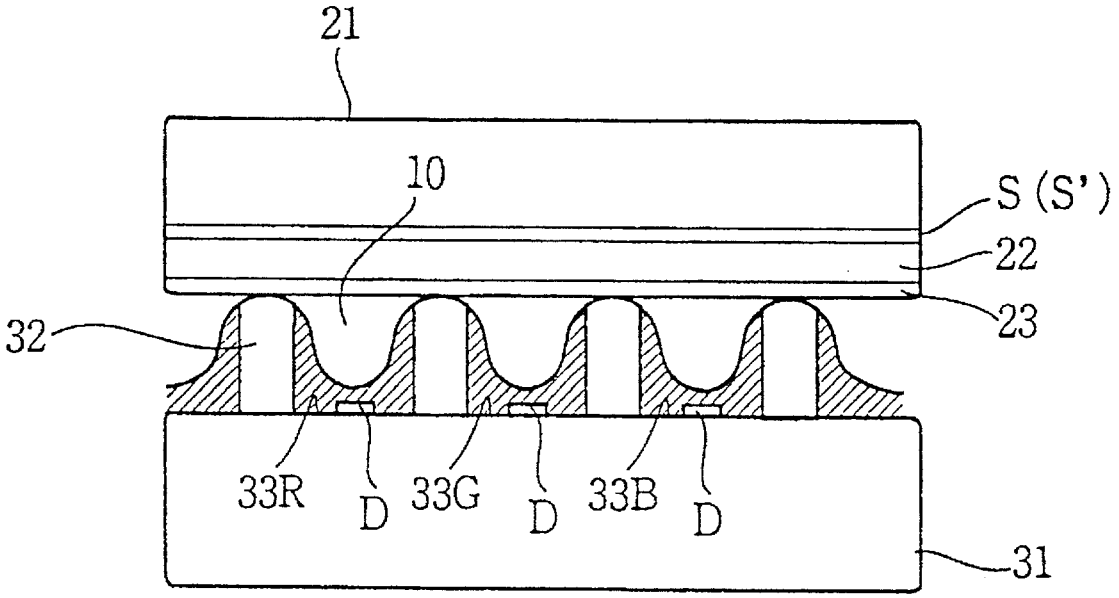
FIG. 1 is a sectional side view showing a PDP of the present invention.

Referring to FIG. 1 showing a PDP having a three-electrode matrix display according to the present invention, the PDP comprises a transparent front substrate 21 made of glass at a display side, and a transparent rear substrate 31 provided corresponding to the front substrate 21 at a distance, thereby forming a discharge space 10 there-between.

A plurality of transparent sustaining (scanning) electrodes S and S' are arranged in pairs on the front substrate 21 to be parallel with each other in the longitudinal direction. A dielectric layer 22 is coated on the front substrate 21 for covering the sustaining electrodes. A MgO layer 23 is coated on the dielectric layer 22.

On the rear substrate 31, a plurality of ribs 32 are parallelly disposed in the lateral direction perpendicular to the sustaining electrodes of the front panel 21. The ribs 32 are provided on the substrate 31. A partition (not shown) arranged as a matrix is provided on the under-side of the substrate 21 to define a plurality of luminous regions (pixels). A plurality of address electrodes D are provided in spaces between the ribs 32. Fluorescent films 33 R, 33G and 33B comprising three primary colors of red (R), green (G) and blue (B) are provided on the address electrodes D in order.

The discharge space 10 is filled with discharge gas which produces ultraviolet rays to excite the fluorescent material. As the discharge gas, Penning gas consisting of neon mixed with xenon and helium is preferably used.

The luminous regions are selectively stimulated to display a picture on the PDP with colors.

The luminous efficacy of a PDP at the unit luminous region is determined dependent on the width, area and electric capacity of the sustaining electrode. Each of these factors has an optimum point. The luminance is increased as the area of the sustaining electrode is increased.

Figure 2:
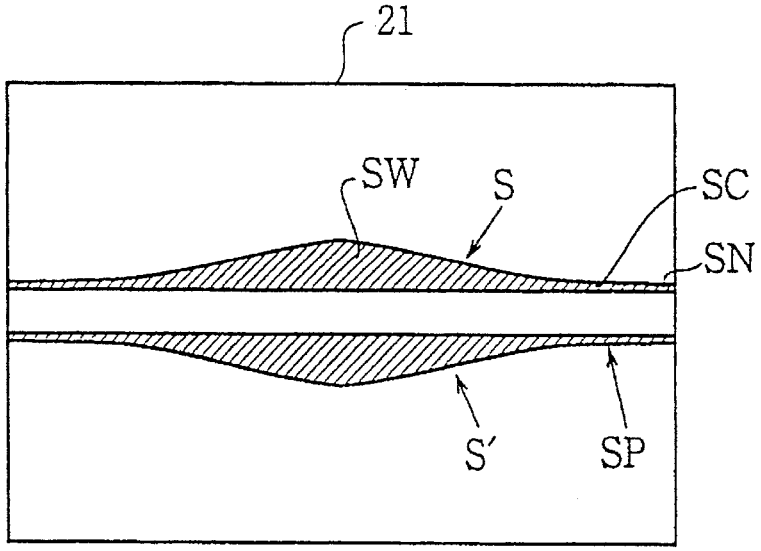
FIG. 2 is a schematic plan view showing a pair of sustaining electrodes provided in the PDP.

FIG. 2 shows a pair of sustaining electrodes S and S' provided on the front substrate 21. Each sustaining electrode has a wide portion SW formed corresponding to a central portion of the PDP and narrow portions SN formed on both ends of the electrode corresponding to opposite peripheral portions of the PDP. The wide portions SW of the electrodes are formed so as to bulge, or expand, on their back faces, i.e., their outer sides which face in a direction away from the other electrode of the pair. The width of the electrode decreases gradually from the central portion to the peripheral portions. In a peripheral region, a constant width portion SC is formed. Thus, both electrodes form a parallel electrode portion SP at the peripheral region.

Consequently, luminous efficacy and luminance are increased in the central portion where the deflection of both substrates is small. Furthermore, although the deflection at the peripheral portions of the glass substrates is large, the area in the parallel electrode portion SP does not change, as described above. Thus, the front and rear substrates are easily positioned.

On the sustaining electrodes S and S', a metallic electrode layer (auxiliary electrode layer) may be partly coated for increasing the electric conductivity of the sustaining electrodes.

Figure 3:
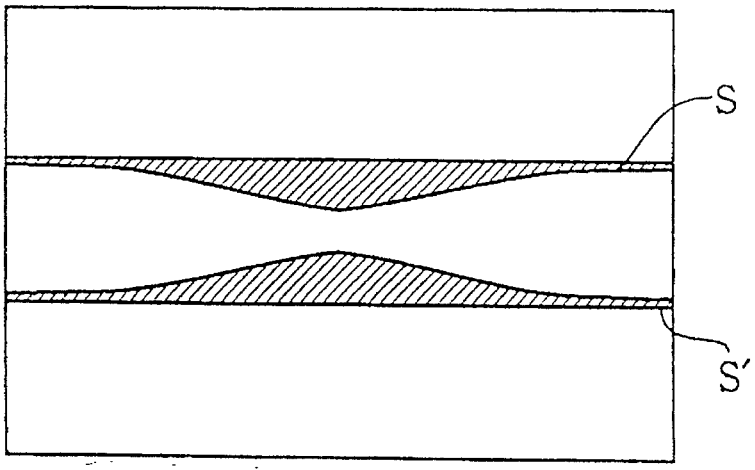
FIG. 3 is a schematic plan view showing a modification of the sustaining electrodes.

Referring to FIG. 3, which shows a modification of the sustaining electrodes S and S', a wide central portion SW of the electrode is formed so as to bulge inward on the inside faces of the electrodes.

In the modification, the same effects as in the case of the first embodiment are obtained.

Figure 4:
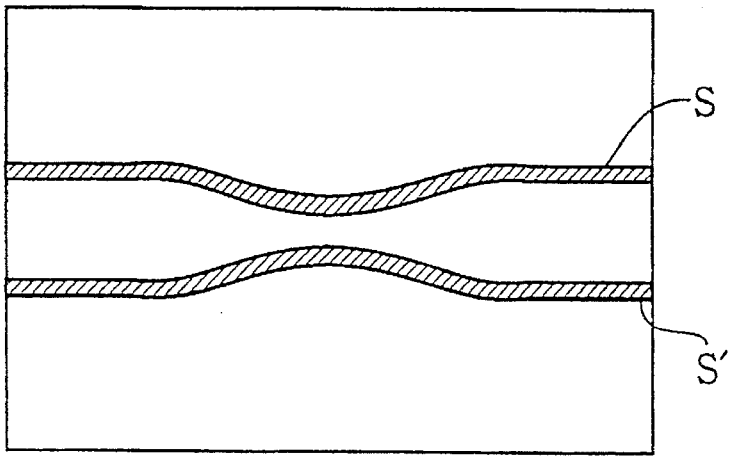
FIG. 4 is a schematic plan view showing another modification of the sustaining electrodes.

FIG. 4 shows another modification of the sustaining electrodes. The electrodes have a constant width and are disposed parallel to each other. A central portion of each electrode is curved toward the opposite electrode, whereby the distance between the electrodes is reduced.

The same effects as with the previous embodiments are obtained.

Figure 5:
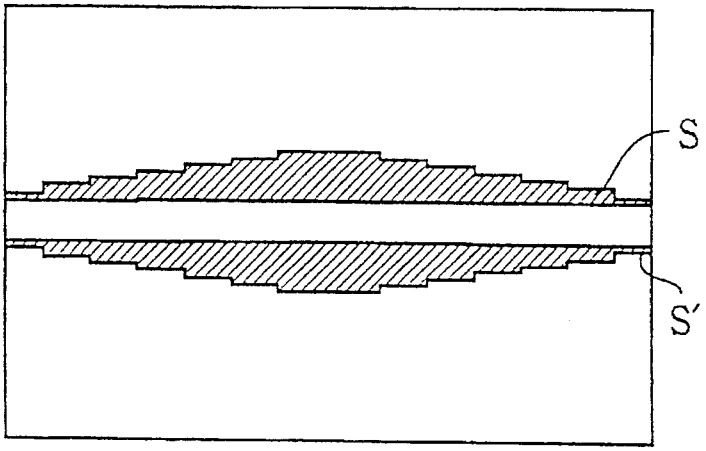
FIG. 5 is a schematic plan view showing a further modification of the sustaining electrodes.

FIG. 5 shows a further modification of the sustaining electrodes where the electrodes disposed in parallel to each other have a wide central portion which expands stepwise in the outward-facing direction from the peripheral to the central region.

The same effects as in the case of the previous embodiments are obtained.

Figure 6A:
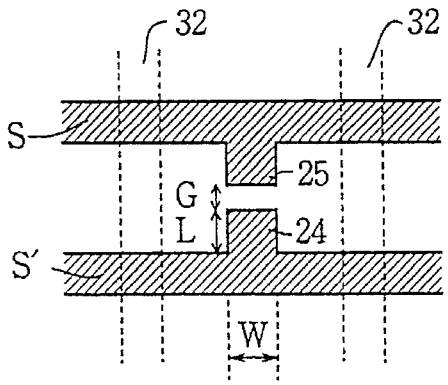
FIGS. 6*a* and 6*b* are schematic plan views showing a further modification of the sustaining electrodes.
Figure 6B:
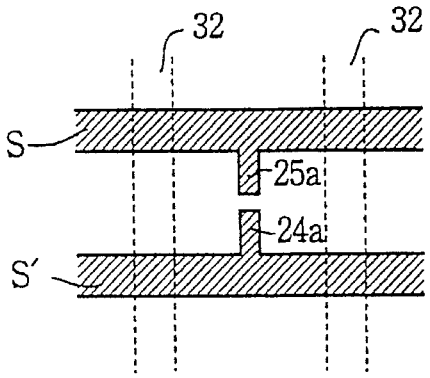

Referring to FIGS. 6*a* and 6*b* showing a still further modification, the sustaining electrodes S have a large width projection 25 formed at each of the pixel locations in the central portion and a small width projection 25*a* formed at each of the pixel locations in the peripheral portion. The sustaining electrodes S' have a large width projection 24 formed corresponding to the large width projection 25 of the respective electrodes S and a small width projection 24*a* formed corresponding to the small width projection 25*a*.

The width W, area A (=W×L), and electric capacity of each of the large width projections 25 and 24 are each larger than those of the corresponding small width projection 25*a* and 24*a*. The luminous efficacy and the luminance are determined dependent on the width W, length L, area A, distance of a gap G, and electric capacity $C=\epsilon(A/d)$ (A: the area of the projection, d: the thickness of the dielectric layer 22, and $\epsilon$: the dielectric constant of the dielectric layer 22). Namely, if the width W, length L, area A, and/or electric capacity C of the large width projections 25 and 24 are increased to set optimum values, it is possible to increase the luminous efficacy and the luminance thereof.

To the contrary, the width, area and electric capacity of the small width projections 25*a* and 24*a* are reduced to reduce the luminance. However, since the peripheral portions of the PDP are less important than the central portion, no problem arises. Power consumption is reduced in the peripheral portion. Since, in the peripheral portion, the width of the small projection is small, the influence of the deflection on the area of the pixel is small.

In this modification, the same effects are obtained as in the previous embodiments.

Figure 7A:
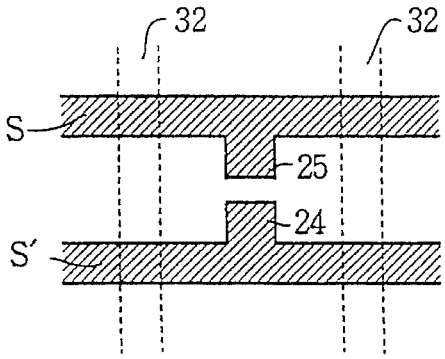
FIGS. 7*a* and 7*b* are schematic plan views showing a modification of the sustaining electrodes of FIGS. 6*a* and 6*b;*
Figure 7B:
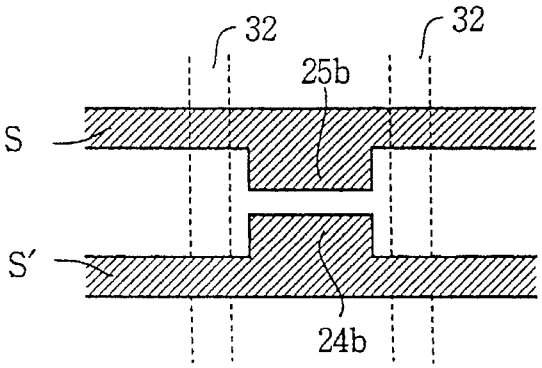
Figure 8:
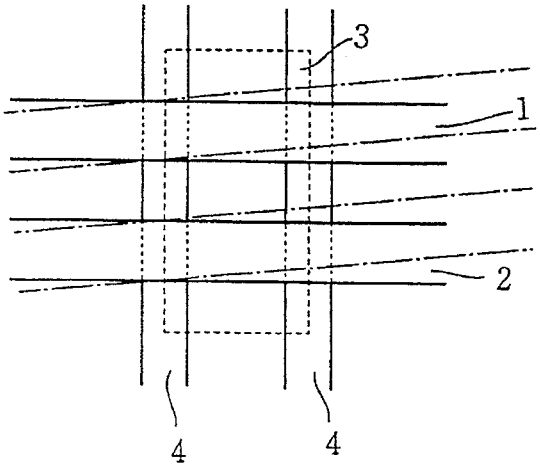
FIG.8 PRIOR ART
FIG. 8 is a schematic plan view showing a part of a conventional PDP.
Figure 9:
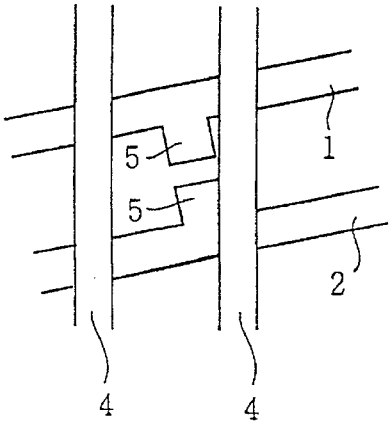
FIG. 9 is a schematic plan view for explaining problems arising in the PDP.

FIGS. 7*a* and 7*b* show a modification of FIGS. 6*a* and 6*b*. The electrodes S and S' have extremely wide projections 25*b* and 24*b* formed in the peripheral portions. In the central portions, the large width projection 25 and 24, which are the same as those of FIG. 6*a*, are formed.

The wide projections 25*b* and 24*b* form a parallel electrode portion. Therefore, the area between the electrodes does not largely change with the deflection of the substrates.

The present invention is applicable to other types of PDP's, such as an opposite discharge PDP of an A.C. type, a face discharge PDP of a D.C. type, and an opposite discharge PDP of a D.C. type.

Furthermore, the present invention is applicable to a transmission type PDP and a reflection type PDP.

In place of the coupled sustaining electrodes, a single sustaining electrode can be used.

In accordance with the present invention, the influence of deflection of the substrates can be reduced at a peripheral portion of the PDP, and the luminous efficacy can be increased in a central portion.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A plasma display panel comprising:

a pair of substrates, a plurality of sustaining electrodes provided between the substrates and arranged in pairs, a plurality of address electrodes disposed in a perpendicular direction to the sustaining electrodes, thereby forming a matrix defining a plurality of pixels, each pixel being defined by a region bordered by a pair of the sustaining electrodes and two of the address electrodes, wherein:

each of the sustaining electrodes has an area in a central pixel area of the panel that is larger than an area of the sustaining electrodes in a peripheral pixel area of the panel.

2. A plasma display panel having a pair of substrates, a plurality of sustaining electrodes provided between the substrates and arranged in pairs, a plurality of address electrodes disposed in a perpendicular direction to the sustaining electrodes, thereby forming a matrix defining a plurality of pixels, each pixel being defined by a region bordered by a pair of the sustaining electrodes and two of the address electrodes, wherein:

each of the sustaining electrodes has a larger width in a lateral direction in a central pixel area of the panel than the width in the lateral direction of the sustaining electrodes in a peripheral pixel area of the panel.

3. A plasma display panel having a pair of substrates, a plurality of sustaining electrodes provided between the substrates and arranged in pairs, a plurality of address electrodes disposed in a perpendicular direction to the sustaining electrodes, thereby forming a matrix defining a plurality of pixels, each pixel being defined by a region bounded by a pair of the sustaining electrodes and two of the address electrodes, wherein:

each of the sustaining electrodes has a lateral projection at each pixel; and the projection in a central area of the panel has a width in a longitudinal direction larger than a longitudinal width of the projection at a peripheral area of the panel.

4. A plasma display panel having a pair of substrates, a plurality of sustaining electrodes provided between the substrates and arranged in pairs, a plurality of address electrodes disposed in a perpendicular direction to the sustaining electrodes, thereby forming a matrix defining a plurality of pixels, each pixel being defined by a region bounded by a pair of the sustaining electrodes and two of the address electrodes, wherein:

each of the sustaining electrodes has a lateral projection at each pixel; and the projection at a central area of the panel has a width in a longitudinal direction smaller than a longitudinal width of the projection at a peripheral area of the panel.

* * * * *